US008991208B2

(12) United States Patent
Kimmel

(10) Patent No.: US 8,991,208 B2
(45) Date of Patent: Mar. 31, 2015

(54) LIQUEFACTION PROCESS PRODUCING SUBCOOLED LNG

(71) Applicant: Ebara International Corporation, Sparks, NV (US)

(72) Inventor: Hans E. Kimmel, Sparks, NV (US)

(73) Assignee: Ebara International Corporation, Sparks, NV (US)

( * ) Notice: Subject to any disclaimer, the term of this patent is extended or adjusted under 35 U.S.C. 154(b) by 0 days.

(21) Appl. No.: 13/906,221

(22) Filed: May 30, 2013

(65) Prior Publication Data

US 2013/0333415 A1 Dec. 19, 2013

Related U.S. Application Data

(63) Continuation-in-part of application No. 12/148,010, filed on Apr. 15, 2008, now abandoned.

(60) Provisional application No. 60/925,263, filed on Apr. 17, 2007.

(51) Int. Cl.
*F25J 1/00* (2006.01)
*F25J 1/02* (2006.01)

(52) U.S. Cl.
CPC ..... *F25J 1/0022* (2013.01); *F25J 1/0042* (2013.01); *F25J 1/0244* (2013.01); *F25J 1/0257* (2013.01); *F25J 2240/30* (2013.01); *F25J 1/0255* (2013.01); *F25J 2210/42* (2013.01); *F25J 2215/02* (2013.01); *F25J 2220/62* (2013.01)
USPC ..... 62/611; 62/613

(58) Field of Classification Search
USPC ..... 290/52; 62/612, 611, 613
See application file for complete search history.

(56) References Cited

U.S. PATENT DOCUMENTS

2009/0229275 A1* 9/2009 Madison ..... 62/50.1

OTHER PUBLICATIONS

Kimmel et al, "Economic and Environmental Benefits of Two-Phase LNG Expanders", Mar. 2004, LNG 14.*
Chiu et al, "Turbo-Expander Technology Development for LNG Plants", May 2001.*
Cholast et al. "Two-Phase LNG Expanders", Feb. 2005, Gas Processors Association-GTL and LNG in Europe.*

* cited by examiner

*Primary Examiner* — Mohammad M Ali
*Assistant Examiner* — Keith Raymond
(74) *Attorney, Agent, or Firm* — Ray K. Shahani; Kin Hung Lai

(57) ABSTRACT

A variable speed liquid LNG expander (X1) and a variable speed two-phase LNG expander (X2) in line, downstream from X1. The rotational speed of both expanders can be controlled and changed independent from each other. The speed of expander X1 and expander X2 is determined in such way that the amount of liquid LNG downstream from the PHS compared to the feed gas supply is maximized and the amount of vapor and boil-off downstream of X2 is minimized.

2 Claims, 3 Drawing Sheets

LIQUEFACTION PROCESS PRODUCING SUBCOOLED LNG

RELATED APPLICATION(S)

This Application is a Continuation-In-Part application to pending U.S. patent application Ser. No. 12/148,010 filed Apr. 15, 2008 entitled NATURAL GAS LIQUEFACTION PROCESS TO EXTEND LIFETIME OF GAS WELLS, which is a non-provisional application to U.S. Provisional Patent Application Ser. No. 60/925,263 filed Apr. 17, 2007 entitled NATURAL GAS LIQUEFACTION PROCESS TO EXTEND LIFETIME OF GAS WELLS, which is also related to U.S. Provisional Patent Application Ser. No. 60/793,167 filed Apr. 18, 2006 entitled NATURAL GAS LIQUEFACTION PROCESS TO EXTEND LIFETIME OF GAS WELLS, both of which are incorporated herein by reference in their entirety, and claims any and all benefits to which it is entitled therefrom.

FIELD OF THE INVENTION

The present invention relates to the method of production of natural gas (LNG), and more particularly to extension of the lifetime of gas wells by utilization of variable speed liquid LNG expander in series with a variable speed 2-phase LNG expander such that amount of liquid LNG produced to the feed gas supply is maximized and the amount of vapor and boil-off downstream is minimized.

BACKGROUND OF THE INVENTION

The depletion of natural gas wells is the subject of increasing technical and economic interest. There are several reasons for this growing interest:

- It is difficult to predict the time when the natural gas well starts to deplete and to estimate the remaining time until the well is completely exhausted.
- Upgrading the facility to an advanced technology is too expensive in relation to the risk connected with the depletion.
- Reduced pressure in the gas well requires injection with nitrogen gas and increases the overall liquefaction costs.

Dr William Cullen, Professor in Chemistry at the Universities of Glasgow and Edinburgh formulated in 1765 his theory of heat and combustion. In 1775 he developed a simple method for producing ice by simply evaporating the air and water vapor from a tank filled with liquid water. Today this refrigeration process is known as evaporation or vacuum cooling.

Evaporation cooling occurs at the liquid-vapor interface. A liquid-to-vapor phase change process requires vaporization heat, which is extracted from the remaining liquid part. Consequently any partial vaporization of a liquid cools the remaining part of the liquid.

Evaporation cooling is applied in gas liquefaction plants, particularly for natural gas liquefaction, to reduce the temperature of the liquefied gas below the condensation temperature. The necessary equipment to introduce evaporation cooling to the LNG liquefaction process is a two-phase LNG expander.

There are numerous references describing the principle of single-phase and two-phase LNG expanders including but not limited to Kikkawa et al., "New Cryogenic Two-Phase Expanders in LNG Production", March/April 2003; Mukaiboh, Atsushi et al., "Two-Phase Expanders Increase Capacity of LNG Liquefaction Trains", April 2006; and Chiu, Chen-Hwa et al., "Two-Phase LNG Expanders Replace Two-Phase Joule-Thompson Valves", April 2004.

FIG. 1 (PRIOR ART) shows a cross section of the design of a two-phase LNG expander such as that manufactured and installed by Ebara International Corporation at the Krio Nitrogen Rejection Plant in Odolanow, Poland "Improvements in Nitrogen Rejection Unit Performance with Changing Gas Compositions" by Cholast et al. and "Two-Phase LNG Expanders" by Kociemba et al. presented a detailed report on the performance of two-phase LNG expanders at the Krio site in Odolanow/Poland.

There are some important differences in the performance of single-phase and two-phase LNG expanders. Two-phase LNG expanders vaporize a certain amount of LNG to subcool the remaining LNG. The reduction of pressure in two-phase expanders is relatively small compared to the pressure difference across a single phase LNG expander, as described in "LNG Expander for Extended Operating Range in Large-Scale Liquefaction Trains" by Kimmel et al. which is hereby incorporated herein by reference in their entirety, without limitations. The performance of single-phase expanders depend only on the mass flow, differential pressure and rotational speed, while the performance of two-phase expanders depends on the composition, temperature, inlet and outlet pressure, volumetric flow and rotational speed. Therefore, changes in the performance characteristic of two-phase expanders have to be adjusted to the momentary process data.

Depleting gas wells are in many cases events which are very difficult to predict in time. Once known, the possible solutions to be applied for depleting gas wells are the same as for new gas wells: To reduce the overall energy consumption for the liquefaction process to a minimum. Each existing equipment of the liquefaction plant has to be analyzed for possible energy savings, and eventually be replaced by more advanced equipment. The costs for upgrades are different for each piece of equipment and some improvements may not be economical for existing plants while other improvements are feasible solutions.

In methods of the prior art, at the location of the natural gas well, wherever it is. The reason for injecting nitrogen into the well is the following: The natural gas at that particular well is not under pressure. To be able to transfer the natural gas out of the well, pressurized nitrogen gas can be injected into the well. Nitrogen is heavier than natural gas and sinks to the bottom of the well. Thus, the lighter natural gas which will be displaced and pushed to the surface by the pressurized nitrogen.

This method is based solely on principles of mechanical engineering and fluid dynamics. The method has the disadvantage to contaminate the natural gas which is a fuel, with nitrogen which is not a fuel, thus decreasing the fuel quality of the natural gas. The expanders described in the literature extract this polluting nitrogen from the LNG by distillation through expansion, a kind of vacuum distillation with nitrogen at its lower boiling temperature. Again, the purpose: is to lift the natural gas out of the well mechanically.

Single-phase and two-phase LNG expanders replacing Joule-Thomson valves increase the LNG production without increasing the energy consumption and are investments that have a payback time of less than six months. In addition, LNG expanders produce electrical energy that reduce the overall energy consumption, to gain the most benefits using LNG expanders.

Non-patent literature TURBO-EXPANDER TECHNOLOGY DEVELOPMENT FOR LNG PLANTS by Chiu does not teach evaporation of nitrogen from a mixture containing LNG in order to cause subcooling of LNG. Rather, Chiu teaches the use of nitrogen as a refrigerant which is compressed and expanded trough several stages of gas expanders to provide necessary conventional refrigeration. Chiu fails to teach or anticipate separation of nitrogen and LNG via evaporation of nitrogen.

Non-patent literature CONTINUOUSLY TRANSIENT OPERATION OF TWO-PHASE LNG EXPANDERS by Finley does not teach evaporation of nitrogen from a mixture with LNG in order to cause subcooling of LNG. Rather, Finley merely references nitrogen rejection plants used for purification of LNG. Finley fails to teach or anticipate subcooling of LNG via evaporation of nitrogen to minimize evaporative cooling or "boil off" losses.

OBJECTS AND ADVANTAGES OF THE PRESENT INVENTION paper presents a new approach to extend the lifetime of depleting gas fields. As used herein the term "LNG" refers to natural gas (primarily methane) which has been liquefied by refrigeration below the boiling point (e.g. −161.5° C., 111.7K depending on constituents of the gas) for storage and transport.

The installation and operation of two-phase LNG expanders reduces the required feed gas supply in existing liquefaction plants, thus extending the lifetime of the gas well. In addition, for nitrogen injected gas wells, or nitrogen rich feed gas, two-phase LNG expanders can handle such feed gas, resulting in sub-cooling the remaining LNG and reducing the entire boil-off downstream of the expander. The investment payback time for LNG expanders is less than six months. The overall plant profit increases by using two-phase LNG expanders in a base-load LNG plant despite the gas well depletion.

It is an object and advantage of the present invention to provide one variable speed liquid LNG expander (X1) and downstream one variable speed two-phase LNG expander (X2) in line. The rotational speed of both expanders can be controlled and changed independent from each other.

It is a further object and advantage of the present invention to describe a method to optimize the output of two expanders in series by varying the rotational speed of each one independently, to obtain the most and the coldest liquid LNG possible. The speed of the expander X1 and the expander X2 is determined in such way that the amount of liquid LNG compared to the feed gas supply is maximized and the amount of vapor and boil-off downstream of X2 is minimized.

It will be understood that in the present invention, there is no need to have a Joule Thompson valve (JT valve) if a two-phase expander is installed. There are essentially three ways to expand pressurized LNG: A. If liquefied LNG is expanded only across a JT valve without an expander, then there will be some vapor formation. B. If the LNG is expanded across a single phase, liquid only expander, then the outlet pressure of the expander has to be high enough not to allow the formation of vapor. The remaining pressure with vapor formation is then expanded across an additional JT valve. This solution is necessary to avoid vapor in the expander. C. If the LNG is expanded across a two-phase (liquid+vapor) expander, then there is no need to provide a JT valve because the two-phase expander expands to relieve the full pressure. Two-phase expanders tolerate vapor in the machine.

As described, it is an object and advantage of the present invention to extend the lifetime of gas wells by decreasing boil-off gas, essentially requiring less gas from the well to maintain the same level of production. Additionally, it is yet a further object and advantage of the present invention is to reduce the importance of lifetime of the gas well, since the same method can be applied to increase production from the gas well. Thus, essentially the same amount of feed gas from the well produces more liquid output.

Nitrogen is injected into the natural gas at the liquefaction site, not at the well. There is no need to pressurize the well since the natural gas is under pressure in the well. The purpose for injection of nitrogen into the natural gas at the liquefaction plant is strictly thermodynamic, and not mechanical. Nitrogen is injected into the LNG and liquefied together with the natural gas. Then, the nitrogen is extracted by two-phase expansion as described herein.

Thus, the nitrogen is evaporated from the LNG which also removes the evaporation heat from the remaining LNG, and subcools the remaining LNG. Subcooled LNG has less boil-off losses than non subcooled LNG. Thus, one purpose of the present invention is to cool and subcool LNG by evaporating nitrogen in a thermodynamic process.

DETAILED DESCRIPTIONS OF THE VARIOUS EMBODIMENTS

Figure 1:
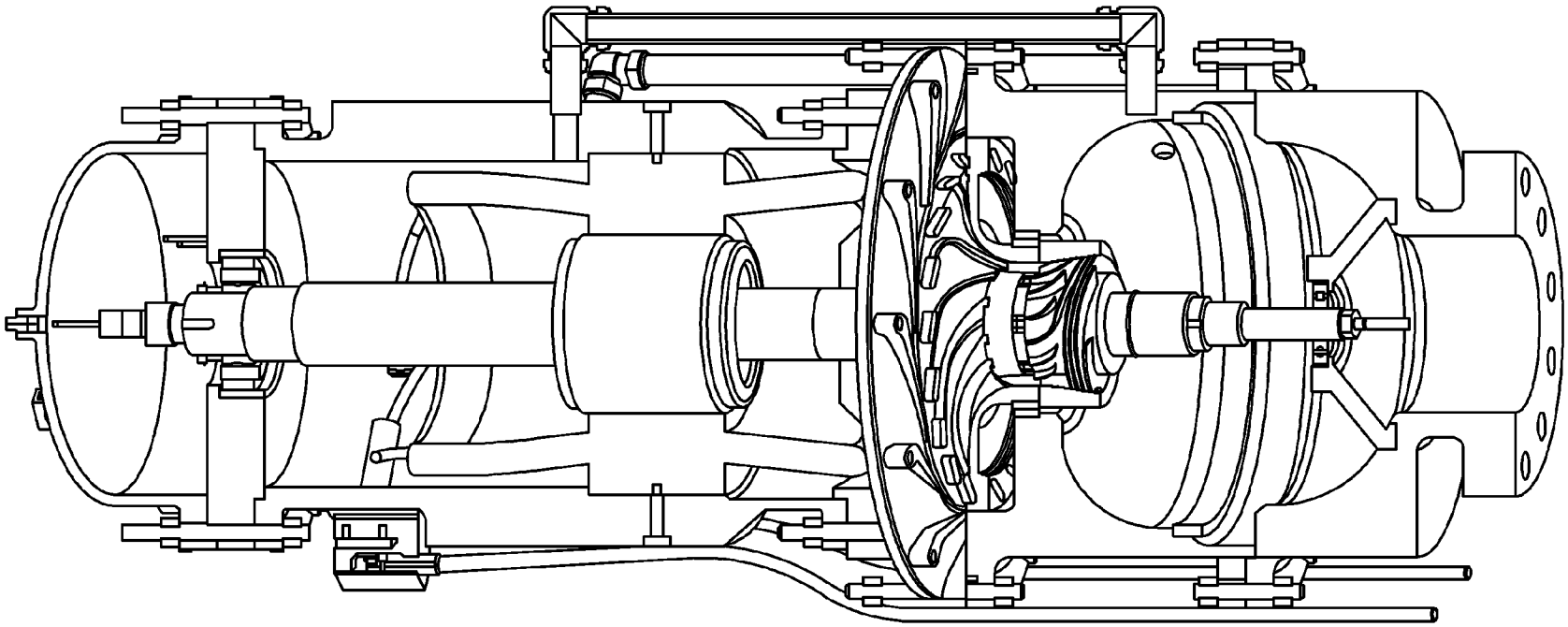
FIG.1 (PRIOR ART)
FIG. 1 (PRIOR ART) shows a cross section of a design of a two-phase LNG expander such as that manufactured and installed by Ebara International Corporation at the Krio Nitrogen Rejection Plant in Odolanow, Poland.

The description that follows is presented to enable one skilled in the art to make and use the present invention, and is provided in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

It will be understood that while numerous preferred embodiments of the present invention are presented herein, numerous of the individual elements and functional aspects of the embodiments are similar. Therefore, it will be understood that structural elements of the numerous apparatus disclosed herein having similar or identical function may have like reference numerals associated therewith.

Figure 2:
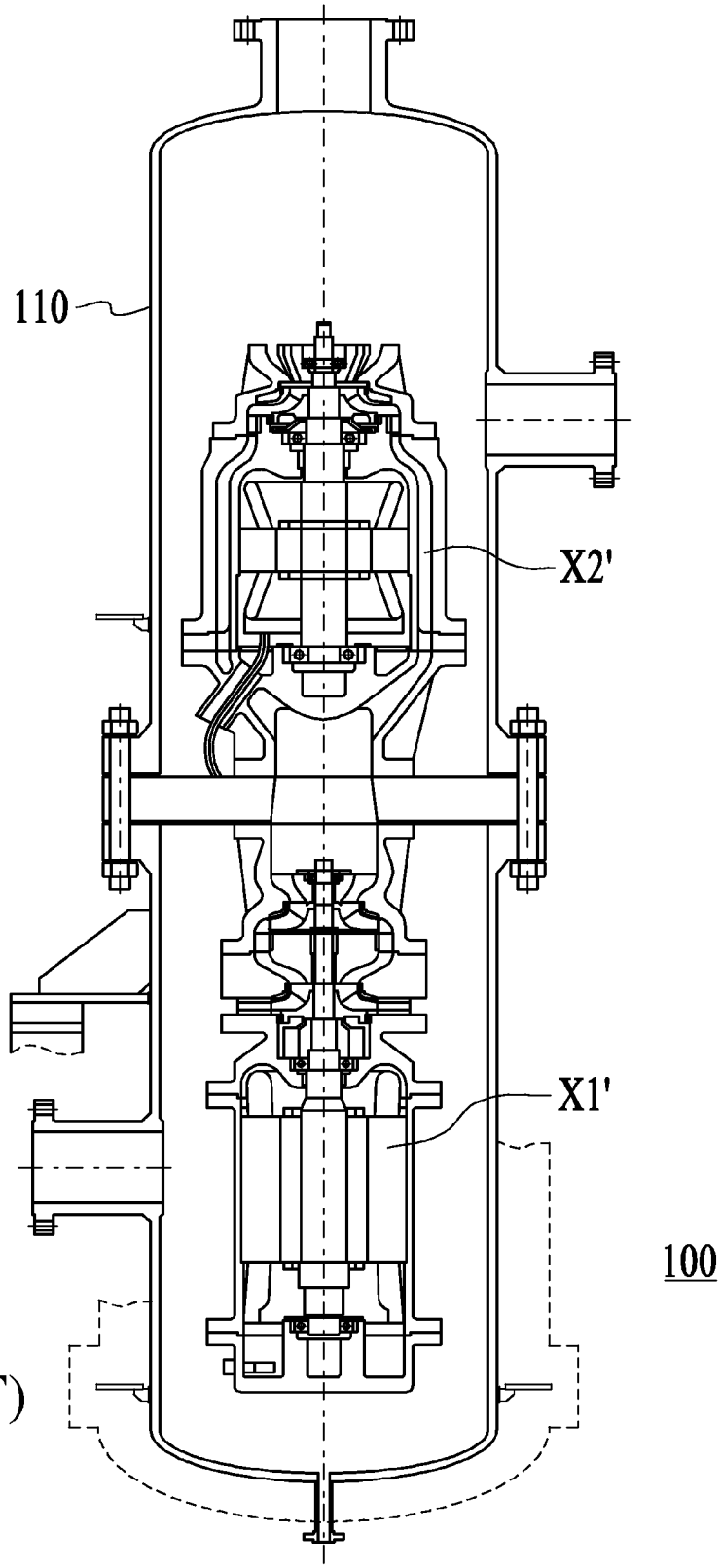
(PRIOR ART) FIG.2
FIG. 2 (PRIOR ART) shows a possible assembly of the present invention consisting of one single-phase expander and one two-phase expander operating in series and mounted together in tandem configuration.

FIG. 2 shows a possible assembly 100 of the present invention consisting of one single-phase expander and one two-phase expander operating in series and mounted together in tandem configuration. The single-phase expander X1 for larger pressure differences and two-phase expander X2 for smaller pressure differences are able to operate independently on different rotational speeds.

To comply with the differences in the performance of single-phase and two-phase LNG expanders, U.S. Patent Application No. 60/705,800 filed Aug. 6, 2005 entitled "Compact Configuration for Cryogenic Pumps and Turbines"

by Madison, which is hereby incorporated herein by reference in their entirety without limitations, presented an assembly of one single-phase expander X1' and one two-phase expander X2' operating in series and mounted together in tandem configuration within one pressure vessel 110.

It will be understood that while FIG. 2 shows expander X1' in series with expander X2' and both contained within a single surrounding vessel, the present invention is not limited thereby. The present invention is directed to optimization of two or more expanders operating in series, either within a single reactor or surrounding enclosure 110 or not.

Figure 3:
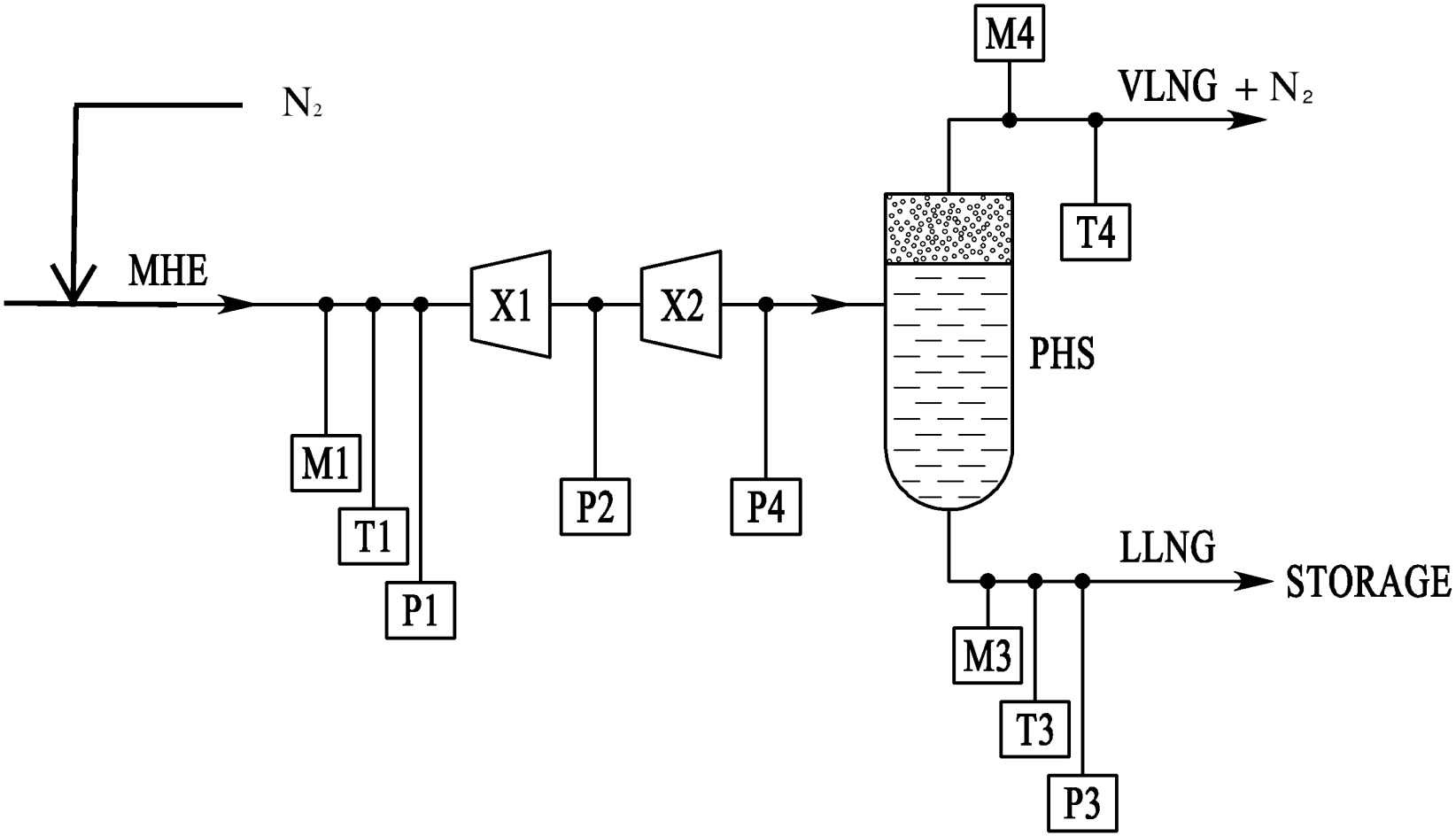
FIG. 3 shows a liquefaction process of the present invention for optimum sub-cooling of LNG using one single-phase X1 and one two-phase X2 LNG expander both operating on variable rotational speed.

FIG. 3 shows a liquefaction process of the present invention for optimum sub-cooling of LNG using one single-phase X1 and one two-phase X2 LNG expander both operating on variable rotational speed. The phase separator PHS is installed downstream and close to the two-phase expander X2. To gain the most benefits from the evaporation cooling process it is necessary to separate the LNG liquid and vapor immediately after the vaporization takes place. During this transitional non-steady state at the exit of the two-phase expander X2 the liquid portion of the LNG is much colder than the vapor portion, and immediate phase separation prevents re-heating of the liquid portion.

The pressurized condensed LNG from the main heat exchanger MHE enters the liquid expander X1 under the inlet condition TI (temperature), P1 (inlet pressure) and M1 (mass flow). The rotational speed of X1 is set to expand the LNG to the outlet pressure P2, which is also the inlet pressure for X2. The rotational speed of X2 is set to optimize the ratio between LNG liquid (LLNG) and vapor (VLNG) under certain conditions. Dependent on the existing process the preferred condition is to produce the most and the coldest LNG. This is achieved through the optimization of a parameter V, where V is one of seven specific ratios of temperature and mass flow rate measured at various locations within the process.

By optimizing the operation of X1 and X2 for the production of the most and coldest LNG, expressed by the value of V, reduces the energy costs and feed gas consumption of the liquefaction plant. The produced LNG vapor is partially re compressed, used as fuel for the gas turbines, or used as cooling medium in heat exchangers.

The variable speed liquid expander X1 and the variable speed two-phase expander X2 are in line, whereas X2 is downstream of X1. From the Main Heat Exchanger of a regular liquefaction process the condensed LNG flows into X1, then into X2 and then into the Phase Separator PHS. X1, X2 and PHS are mounted close together to avoid unnecessary losses in the piping system.

The Phase Separator separates the liquid LNG portion from the vapor LNG portion. The vapor LNG (VLNG) is extracted on top of the PHS and the liquid LNG portion (LLNG) is extracted from the bottom of the PHS.

At the inlet of X1 are equipment to measure the mass flow M1, the temperature TI and the pressure P1 of the incoming LNG.

At the outlet of X1 and the inlet X2 is the equipment to measure the pressure P2.

At the outlet of the PHS for the liquid portion LLNG but located as close as possible to the LLNG storage are equipment to measure the mass flow M3, the temperature T3 and the pressure P3. At the outlet of PHS for the vapor portion VLNG is the equipment to measure the mass flow M4 and the temperature T4 of the LNG vapor.

The operation of X1 and X2 is determined by a central process control. The purpose is to obtain and maintain a maximum liquid temperature difference between T3 (temperature of LLNG) and T1 (temperature of LNG at inlet to X1) while keeping as close to constant the mass flow rates M1, M3, and M4. Therefore, the object is to optimize one of the following values V1, V2, V3, V4, V5, V6, or V7.

$V1=(T1-T3)/(M1-M3)$>>>search for maximum value $V2=M3/M1$>>>search for maximum value $V3=(T1-T3)M3/M1$>>>search for maximum value $V4=M1-M3$>>>search for minimum value $V5=(T1-T3)\times(M3-M4)$>>>search for maximum value $V6=(T1-T3)\times M3-(T1-T4)\times M4$>>>search for maximum value $V7=(T1-T3)\times M3/((T1-T4)\times M4)$>>>search for maximum value To search for optimum values:

Step 1: For a certain flow M1 the rotational speed of X1 parameter S is a first chosen and will produce a pressure difference P2−P1. The rotational speed R of X2 is determined by the pressure difference P3−P2.

Step 2: The corresponding values of M1, M3, M4, T1, T3 and T4 are measured and at least one of the values V1 through V7 is calculated.

Step 3: Based on the value calculated in Step 2, the parameter S (S=rotational speed of X1) is varied by a small amount, thus the rotational speed R of X2, and measured values M1, M3, M4, T1, T3, and T4 change.

Then Step 2 and 3 are repeated, The new value of V is compared to the previous value and the speed of X1 is adjusted. By measuring, calculating and comparing values and adjusting speed parameter S results in a more or less optimized value.

By repeating the steps until the optimum of at least one of the values V1 through V7 is found, the purpose of the invention is achieved: to minimize the feed gas supply by reducing the LNG vaporization and the LNG boil-off downstream the expanders. Reducing the feed gas supply for a given output of liquid LNG extends the lifetime of the gas well.

For every change of the composition, temperature and pressure of the LNG this procedure has to be repeated, because the optimum performance of the two-phase expander depends on these values and any change in the plant condition will effect the optimization. A frequent or continuous search for the optimum is proposed.

The maximum design pressure for X1 is greater than the maximum pressure difference (P2−P1), and for a preferred embodiment the maximum design pressure difference is approximately (P2−P1)+0.5×(P4−P2).

P4 is the outlet pressure at X2.

In another embodiment and in addition to the maximum design pressure for X1 as described above, the maximum design pressure for X2 is greater than the maximum pressure difference (P4−P2). These embodiments allow the operation of X1 and X2 in such a manner that one expander is expanding a higher pressure difference than the other. In any operational case the total pressure difference will not exceed the difference (P4−P1).

Extension of Lifetime of Gas Well vs. Increase in Production of Gas Well

As described above, the present invention can extend the lifetime of gas wells by decreasing boil-off gas, essentially requiring less gas from the well to maintain the same level of production. Additionally, the present invention is a method to increase production from the gas well. Thus, essentially the same amount of feed gas from the well produces more liquid output. The same methodology can be used to either extend the lifetime of the gas well or used to increase production from the gas well, depending upon plant economics or other plant operating policy.

Both increasing the life time for a given output and increasing production for a given input are analog goals in the present invention. The proposed method reduces the temperature of the produced LNG. Causing this reduction in temperature has the following benefit: Downstream of the expander and phase separator the LNG can be transferred to other locations and stored either in fixed storage tanks or in mobile tanker ships.

During these transfer and storage operations, heat from the environment is conducted to the LNG and warms up the LNG, thus vaporizing a volume of LNG. This vaporized LNG, also named boil-off, is usually lost and has to be re-supplied by the feed gas. The amount of heat supplied by the environment is directly related to the volume of LNG vaporized by the heat.

Thus, reducing the boil-off of liquid LNG downstream of the expander and phase separator reduces the feed gas supply rate requirement for a given LNG output and extends the life time of the well. However, reducing the boil-off of liquid LNG downstream of the expander and phase separator for a given feed gas supply rate increase results in an increase in production. It will be understood that a balancing of these outcomes can be achieved in order to optimize the plant economics. Driving the system in one direction or another will depend upon the goals set by the operating engineers, design engineers and plant management.

As mentioned above and best shown in FIG. 3, in one embodiment of the present invention nitrogen is injected into the natural gas at the liquefaction site, not at the well. The nitrogen can be injected into the stream of LNG or other cryogenic liquid either prior to or subsequent to any one, two or all three of MHE, X1 or X2. There is no need to pressurize the well since the natural gas is under pressure in the well. The purpose for injection of nitrogen into the natural gas at the liquefaction plant is strictly thermodynamic, and not mechanical. Nitrogen is injected into the LNG and liquefied together with the natural gas. Then, the nitrogen is extracted by two-phase expansion as described herein.

As best shown in FIG. 3, the nitrogen is evaporated from the LNG which also removes the evaporation heat from the remaining LNG, and subcools the remaining LNG. The evaporated nitrogen and VLNG are combined and removed from the PHS in the vapor phase, and can also be separated in a subsequent step or steps. Subcooled LNG has less boil-off losses than non subcooled LNG. Thus, one purpose of the present invention is to cool and subcool LNG by evaporating nitrogen in a thermodynamic process.

CONCLUSION

Installation and use of a variable speed two-phase LNG expanders in combination with variable speed single-phase LNG expander in conjunction with the above described optimization method, presents the most advantageous solution for improving existing and new liquefaction plants, reducing the overall feed gas supply by reducing the overall energy consumption and extending the lifetime of gas wells. With its short payback time of less than six months LNG expanders are economical solutions for existing and new liquefaction plants.

Unless defined otherwise, all technical and scientific terms used herein have the same meaning as commonly understood by one of ordinary skill in the art to which the present invention belongs. Although any methods and materials similar or equivalent to those described can be used in the practice or testing of the present invention, the preferred methods and materials are now described. All publications and patent documents referenced in the present invention are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

I claim:

1. A method for optimum sub-cooling of LNG to reduce boil-off losses at a liquefaction plant that produces LNG, the method comprising the following steps:

Providing a source of substantially nitrogen-free LNG;

Injecting nitrogen into pressurized natural gas with a nitrogen injector at the liquefaction plant as a first step in sub-cooling the substantially nitrogen-free LNG, thereby producing a nitrogen-rich feed gas supply;

Liquefying the nitrogen-rich feed gas supply with a main heat exchanger to form nitrogen-rich, pressurized condensed LNG;

Introducing the nitrogen-rich pressurized condensed LNG to a single-phase liquid expander contained within an initial surrounding vessel under inlet temperature, inlet pressure and inlet mass flow;

Setting a rotational speed of the single-phase expander to expand the LNG to outlet pressure;

Operating the single-phase expander to process the nitrogen-rich pressurized condensed LNG;

Setting a rotational speed of a two-phase liquid expander contained within a second surrounding vessel operating in series with the single-phase expander to decrease boil-off gas and optimize a ratio between liquid LNG and vapor LNG; and Operating the two-phase expander to process the nitrogen-rich pressurized condensed LNG received from the single-phase expander and separating the nitrogen from the LNG by evaporation of the nitrogen, whereby the process is optimized to produce subcooled liquid LNG to reduce boil-off losses.

2. A method for optimum sub-cooling of LNG to reduce boil-off losses at a liquefaction plant that produces LNG, the method comprising the following steps:

Providing a source of substantially nitrogen-free LNG

Injecting nitrogen into pressurized natural gas with a nitrogen injector at the liquefaction plant as a first step in sub-cooling the substantially nitrogen-free LNG to produce a nitrogen-rich feed gas supply;

Liquefying the nitrogen-rich feed gas supply with a main heat exchanger (MHE) to form nitrogen-rich, pressurized condensed LNG;

Introducing the nitrogen-rich, pressurized condensed LNG to a single-phase liquid expander (X1) contained within an initial surrounding vessel under inlet temperature (T1), inlet pressure (P1) and mass flow (M1);

Setting a rotational speed of X1 to expand the LNG to an outlet pressure (P2);

Operating X1 to process the nitrogen-rich pressurized condensed LNG;

Setting a rotational speed of a two-phase liquid expander (X2) contained within a second surrounding vessel and operating in series with the single-phase expander to decrease boil-off gas and optimize a ratio between liquid LNG (LLNG) and vapor LNG (VLNG); and Operating X2 to remove nitrogen from the LLNG by evaporation, thus subcooling the liquid LNG, whereby the process is optimized by either maximizing one of the following values:

$$V1=(T1-T3)/(M1-M3);$$

$$V2=M3/M1;$$

$$V3=(T1-T3)M3/M1;$$

$$V5=(T1-T3)\times(M3-M4);$$

$$V6=(T1-T3)\times M3-(T1-T4)\times M4;$$

$$V7=(T1-T3)\times M3/((T1-T4)\times M4);$$

or minimizing the following value V4:

$$V4=M1-M3;$$

with temperature T1 at the inlet to X1, temperature T3 of the liquid outlet of a phase separator (PHS), temperature T4 of the vapor leaving the PHS, mass flow M1 into X1, liquid mass flow M3 out of the PHS, vapor mass flow M4 out of the PHS and pressure P3 at a liquid LNG outlet, thereby reducing boil-off losses while producing LLNG at temperature T3.

* * * * *